US011346031B2

(12) United States Patent
Ueda et al.

(10) Patent No.: US 11,346,031 B2
(45) Date of Patent: May 31, 2022

(54) SEWING MACHINE

(71) Applicant: BROTHER KOGYO KABUSHIKI KAISHA, Nagoya (JP)

(72) Inventors: Daisuke Ueda, Seto (JP); Nobuhiko Funato, Gifu (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 47 days.

(21) Appl. No.: 16/925,969

(22) Filed: Jul. 10, 2020

(65) Prior Publication Data

US 2020/0340160 A1 Oct. 29, 2020

Related U.S. Application Data

(63) Continuation of application No. PCT/JP2018/046504, filed on Dec. 18, 2018.

(30) Foreign Application Priority Data

Jan. 11, 2018 (JP) ..... JP2018-002399

(51) Int. Cl.

| | |
|---|---|
| ***D05B 65/02*** | (2006.01) |
| ***D05B 27/24*** | (2006.01) |
| ***D05B 37/04*** | (2006.01) |
| ***D05B 69/12*** | (2006.01) |

(52) U.S. Cl.

CPC ..... *D05B 65/02* (2013.01); *D05B 27/24* (2013.01); *D05B 37/04* (2013.01); *D05B 69/12* (2013.01)

(58) Field of Classification Search

CPC ..... D05B 27/24; D05B 65/02; D05B 37/04; D05B 69/12

See application file for complete search history.

(56) References Cited

U.S. PATENT DOCUMENTS

| | | | | |
|---|---|---|---|---|
| 4,368,683 | A * | 1/1983 | Takenoya | D05B 27/24 112/314 |
| 2007/0227419 | A1* | 10/2007 | Hirose | D05B 65/02 112/2 |
| 2009/0199754 | A1 | 8/2009 | Niizeki et al. | |

FOREIGN PATENT DOCUMENTS

| | | | |
|---|---|---|---|
| JP | 2007-244721 | A | 9/2007 |
| JP | 2007-282978 | A | 11/2007 |
| JP | 2009-183537 | A | 8/2009 |

OTHER PUBLICATIONS

Apr. 2, 2019 Search Report issued in International Patent Application No. PCT/JP2018/046504.

(Continued)

*Primary Examiner* — Nathan E Durham
(74) *Attorney, Agent, or Firm* — Oliff PLC

(57) ABSTRACT

A sewing machine includes a needle plate, a feed dog configured to move a workpiece, a vertical drive mechanism configured to vertically drive the feed dog, a switch mechanism, a cutting mechanism, and an actuator. The switch mechanism is configured to switch from an active state where the feed dog is driven, by the vertical drive mechanism, above and below an upper surface of the needle plate to an inactive state where an upper surface of the feed dog is maintained below the upper surface of the needle plate. The cutting mechanism includes a blade configured to cut a thread at a position below the needle plate. The actuator is configured to commonly drive the switch mechanism and the cutting mechanism.

6 Claims, 8 Drawing Sheets

(56) References Cited

OTHER PUBLICATIONS

Jul. 14, 2020 International Preliminary Report on Patentability issued in International Patent Application No. PCT/JP2018/046504.

* cited by examiner

SEWING MACHINE

CROSS-REFERENCE TO RELATED APPLICATION

This is a continuation application of International Application No. PCT/JP2018/046504 filed on Dec. 18, 2018 which claims priority from Japanese Patent Application No. 2018-002399 filed on Jan. 11, 2018. The entire contents of the earlier applications are incorporated herein by reference.

TECHNICAL FIELD

Aspects of the disclosure relate to a sewing machine.

BACKGROUND

A known sewing machine includes a thread cutter for cutting an upper thread and a lower thread. The thread cutter includes a first thread catcher, a second thread catcher, a blade, and a motor. The first thread catcher reciprocates to catch an upper thread and a lower thread. The second thread catcher catches the upper and lower threads caught by the first thread catcher while the first thread catcher moves back, and then the second thread catcher moves the upper and lower threads toward the blade. The blade cuts the upper and lower threads moved by the second thread catcher. The motor drives the first thread catcher and the second thread catcher.

Another known sewing machine includes a needle plate and a feed dog. In order to allow a user to sew a fabric while moving the fabric in a desired direction, a feed dog is maintained below a needle plate. The sewing machine includes a contact moving member, a first slide lever, a second slide lever, a swing lever, a driven gear, and a descent motor. The descent motor drives the driven gear to move, via a pin engaged with a helical groove cam, the first slide lever which, in turn, swings the swing lever to move, via the second slide lever, the contact moving member. The contact moving member moves a vertical feed contact of a feed dog vertically moving mechanism from an eccentric cam to a concentric cam of a lower shaft. In this case, the feed dog is maintained at a descent position blow the needle plate.

SUMMARY

Providing separate motors for a sewing machine to respectively drive a mechanism for cutting a thread and a mechanism for maintaining a feed dog below a needle plate may increase the size of the sewing machine.

Aspects of the disclosure provide a sewing machine including a common drive source configured to drive a mechanism for cutting a thread and a mechanism for maintaining a feed dog below a needle plate.

According to one or more aspects of the disclosure, a sewing machine includes a needle plate, a feed dog configured to move a workpiece, a vertical drive mechanism configured to vertically drive the feed dog, a switch mechanism, a cutting mechanism, and an actuator. The switch mechanism is configured to switch from an active state where the feed dog is driven, by the vertical drive mechanism, above and below an upper surface of the needle plate to an inactive state where an upper surface of the feed dog is maintained below the upper surface of the needle plate. The cutting mechanism includes a blade configured to cut a thread at a position below the needle plate. The actuator is configured to commonly drive the switch mechanism and the cutting mechanism.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

Overview of Sewing Machine 1

Figure 1:
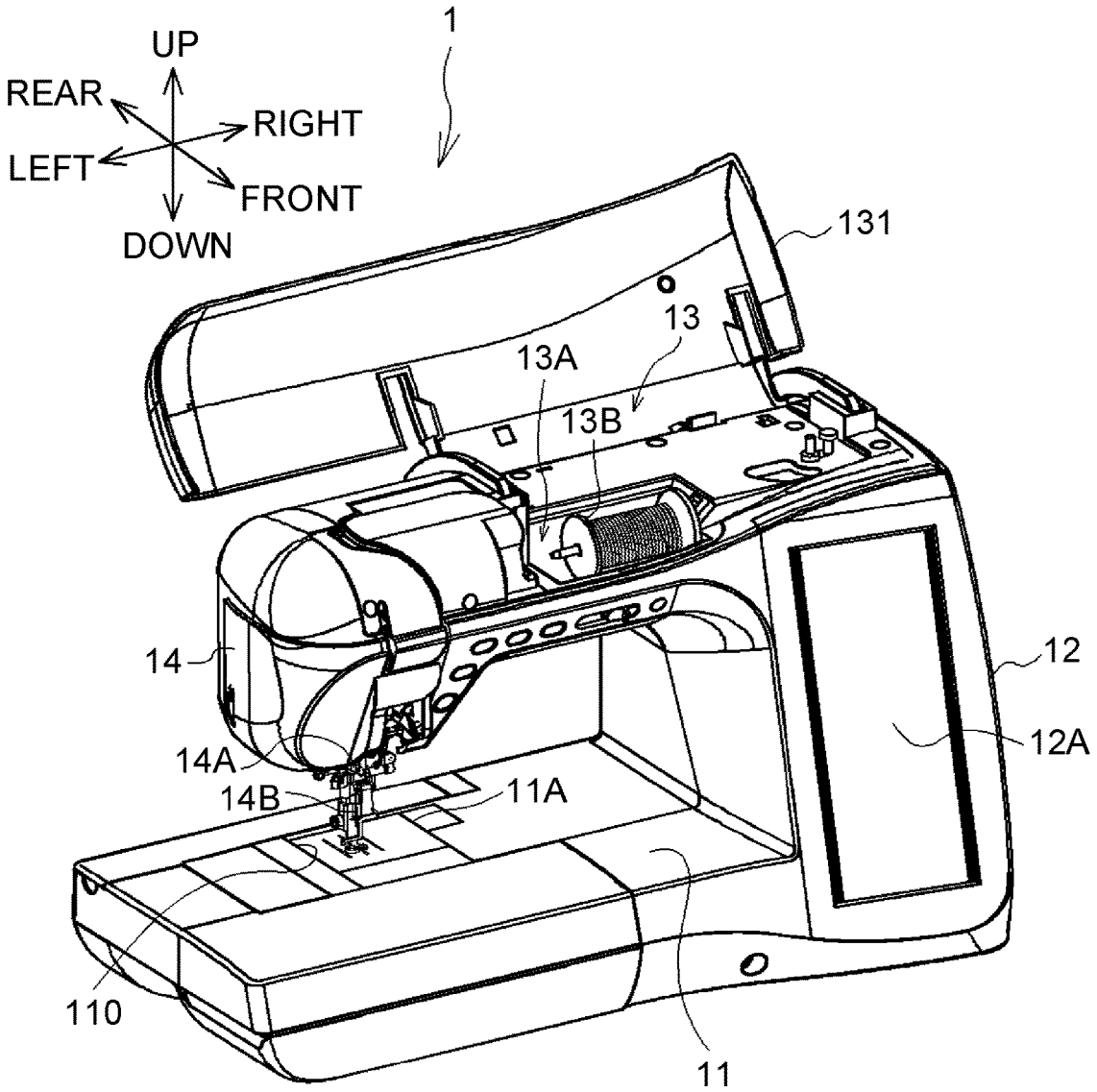
FIG. 1 is a perspective view of a sewing machine according to an illustrative embodiment of the disclosure.

A sewing machine 1 according to an illustrative embodiment of the disclosure will be described with reference to the accompanying drawings. Referring to FIG. 1, a physical structure of the sewing machine 1 will be described. Hereinafter, a lower left side, upper right side, an upper left side, a lower right side of FIG. 1 respectively correspond to a left side, a right side, a rear side, and a front side of the sewing machine 1. The sewing machine 1 mainly includes a bed 11, an upright arm 12, and a horizontal arm 13. The upright arm 12 extends vertically from a right end of the bed 11. The horizontal arm 13 extends leftward from an upper end of the upright arm 12 to face the bed 11. The horizontal arm 13 includes, at its distal end, a head 14.

The bed 11 has an upper surface extending horizontally and detachably supports a needle plate 11A. The needle plate 11A is rectangular in plan view. The needle plate 11A is detachably attached to an opening 110 in an upper surface of the bed 11. The needle plate 11A has a needle hole and square holes. The needle hole is located at a substantially central portion of the needle plate 11A for insertion of a needle 14B to be described later. A feed dog 2A shown in FIG. 2 is insertable from below into a square hole.

The bed 11 accommodates therein a lower shaft 1A (refer to FIG. 3) extending in a left-right direction. The lower shaft 1A is rotationally driven by a sewing machine motor (not shown). The lower shaft 1A drives a shuttle mechanism K (refer to FIG. 2) disposed in the bed 11 at a position below the needle plate 11A. A cylindrical coupling 10A (refer to FIGS. 4 and 5A to 5C) is fixed to an outer peripheral surface of a portion of the lower shaft 1A. A distance from an axis of the lower shaft 1A to an outer peripheral surface of the coupling 10A is greater than a distance from the axis of the lower shaft 1A to the outer peripheral surface of the lower shaft 1A. The coupling 10A includes a second cam 10 (refer to FIGS. 4 and 5A to 5C). The second cam 10 is an eccentric cam. Hereinafter, a portion of the periphery of the second cam 10 having a large diameter is referred to as a "large-diameter peripheral portion" and a portion of the periphery of the second cam 10 having a small diameter is referred to as a "small-diameter peripheral portion". A distance from the axis of the lower shaft 1A to the small-diameter peripheral portion of the second cam 10 is equal to a distance from the axis of the lower shaft 1A to the outer peripheral surface of the coupling 10A. The second cam 10 transmits a rotational drive force of the lower shaft 1A to a vertical drive mechanism 2 to be described later.

Figure 2:
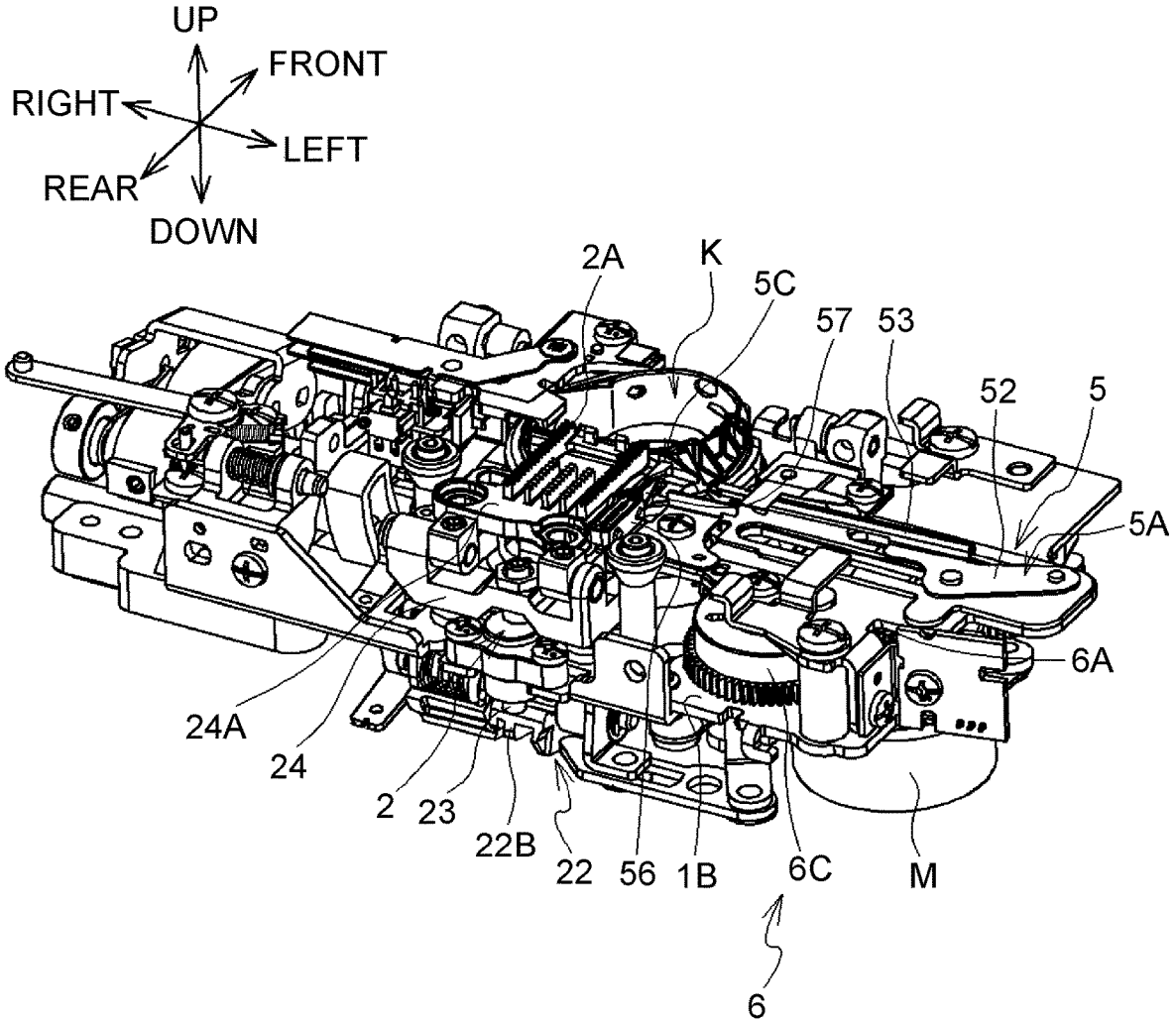
FIG. 2 is a perspective view of a vertical drive mechanism, a cutting mechanism, and a gear unit.

The bed 11 further accommodates therein a known front-rear feed mechanism (not shown), the vertical drive mechanism 2 (refer to at least FIG. 2), a switch mechanism 3 (refer to at least FIG. 4), a cutting mechanism 5 (refer to at least FIG. 2), a gear unit 6 (refer to FIG. 2), and a motor M (refer to at least FIG. 2). The lower shaft 1A rotationally drives the front-rear feed mechanism which in turn drives the feed dog 2A in a front-rear direction. The feed dog 2A feeds a workpiece, such as a fabric, by a predetermined feed amount. The vertical drive mechanism 2, the switch mechanism 3, the cutting mechanism 5, the gear unit 6, and the motor M will be described in detail later.

The upright arm 12 includes a liquid crystal display (hereinafter referred to simply as LCD) 12A in portrait orientation. The LCD 12A displays thereon names of various functions to be executed and various messages necessary for sewing processes, including selection and editing of sewing patterns. The horizontal arm 13 includes, at its upper portion, an openable cover 131. FIG. 1 shows a state where the cover 131 is open. An accommodating portion 13A is located below the closed cover 131 or inside the horizontal arm 13. The accommodating portion 13A is a recess for accommodating a spool 13B around which an upper thread is wounded. The head 14 includes, at its lower portion, a needle bar 14A. A needle 14B is attachable to a lower end of the needle bar 14A. The head 14 includes therein a needle bar moving mechanism (not shown) and a take-up mechanism (not shown). The needle bar moving mechanism vertically drives the needle bar 14A with the needle 14B. The take-up mechanism takes up an upper thread during a sewing process.

Vertical Drive Mechanism 2

The vertical drive mechanism 2 is a known mechanism for vertically driving the feed dog 2A. An example of the vertical drive mechanism 2 is described, for example, in Japanese Laid-Open Patent Publication No. 2007-244721, and therefore will be briefly described below. The vertical drive mechanism 2, which is driven by the lower shaft 1A, drives the feed dog 2A. As shown in FIGS. 2 to 5C, the vertical drive mechanism 2 includes a vertical feed contact 22 (refer to FIGS. 2, 4, and 5A to 5C), a vertical movement pin 23 (refer to FIGS. 2 and 5A to 5C), and a feed stand 24 (refer to FIGS. 2 and 3).

As shown in FIGS. 4 and 5A to 5C, the vertical feed contact 22 is supported rotatably about a rotation shaft 221 extending in the left-right direction and movably along the rotation shaft 221 in the left-right direction. The vertical feed contact 22 is urged leftward by a first urging member (not shown). The vertical feed contact 22 is also urged clockwise by a second urging member (not shown) when viewed from the right (refer to FIGS. 5A to 5C).

Figure 4:
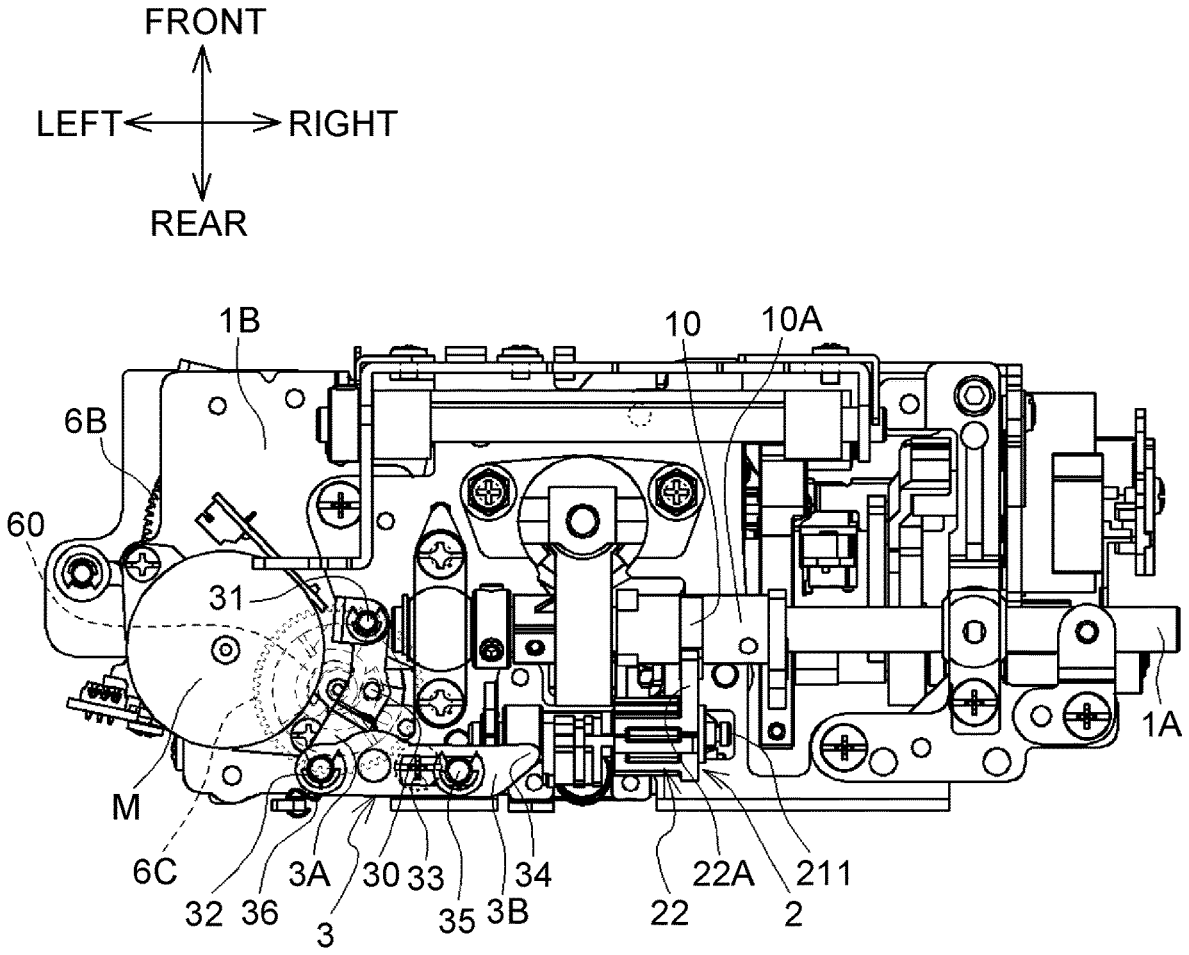
FIG. 4 is a view from below of the vertical drive mechanism and the switch mechanism when a motor is in an initial state.

As shown in FIG. 4, the vertical feed contact 22 includes, at its right end, a second contact member 22A. The second contact member 22A, when located at the same portion as the second cam 10 in the left-right position, is in contact with the periphery of the second cam 10. The second contact member 22A, when located further to the right than the second cam 10, is out of contact with the periphery of the second cam 10, as described later referring to FIG. 8. Movement of the vertical feed contact 22 in the left-right direction switches the second contact member 22A in or out of contact with the periphery of the second cam 10. As the second cam 10 rotates while the second contact member 22A is in contact with the periphery of the second cam 10, the vertical feed contact 22 rotates about the rotation shaft 221, as described later referring to FIGS. 5A and 5B. As shown in FIGS. 2 and 5A to 5C, the vertical feed contact 22 includes, at its rear left end, a contact portion 22B. The contact portion 22B moves vertically as the vertical feed contact 22 rotates.

As shown in FIG. 2, the vertical movement pin 23 has a rod shape and extends vertically. The vertical movement pin 23 is supported, above the contact portion 22B of the vertical feed contact 22, to be vertically movable. A lower end of the vertical movement pin 23 contacts, from above, the contact portion 22B (refer to FIGS. 5A to 5C). As the contact portion 22B moves in response to rotation of the vertical feed contact 22, the vertical movement pin 23 moves vertically. The feed stand 24 is connected to an upper end of the vertical movement pin 23. The feed stand 24 is vertically movable as the vertical movement pin 23 moves vertically. The feed stand 24 holds, at its upper end, a plate 24A. The feed dog 2A is disposed on an upper surface of the plate 24A and moves vertically as the feed stand 24 moves vertically. A third urging member (not shown) urges down the feed stand 24. The lower end of the vertical movement pin 23 connected to the feed stand 24 is pushed down, due to an urging force of the third urging member, against the contact portion 22B of the vertical feed contact 22.

Operation of Vertical Drive Mechanism 2

Figure 5A:
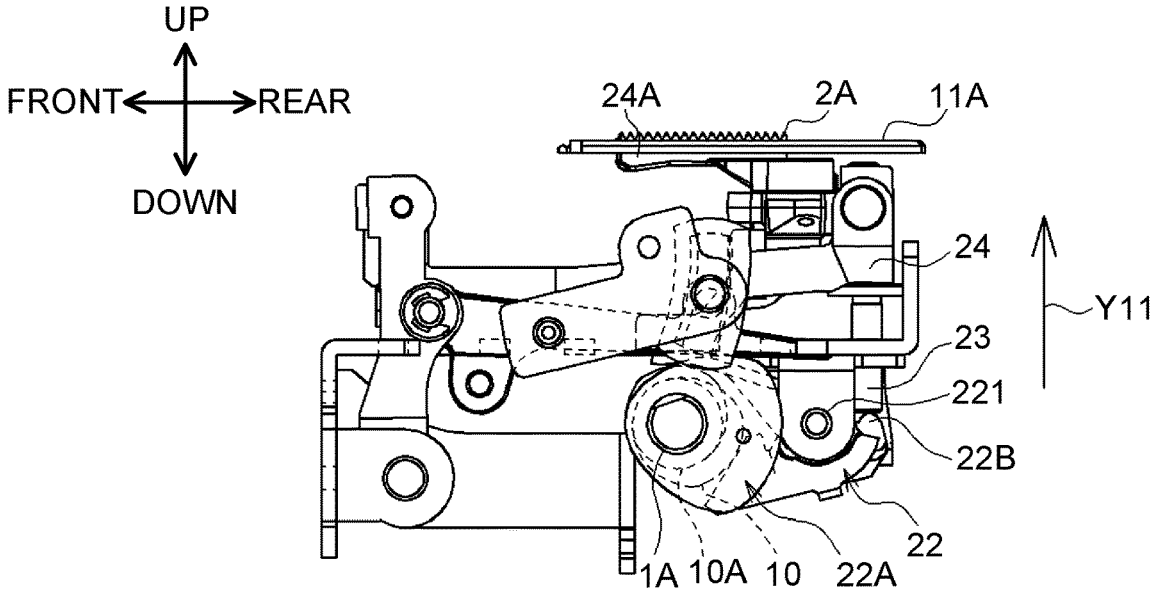
FIG. 5A is a view of the vertical drive mechanism when the sewing machine is in an active state.
Figure 5B:
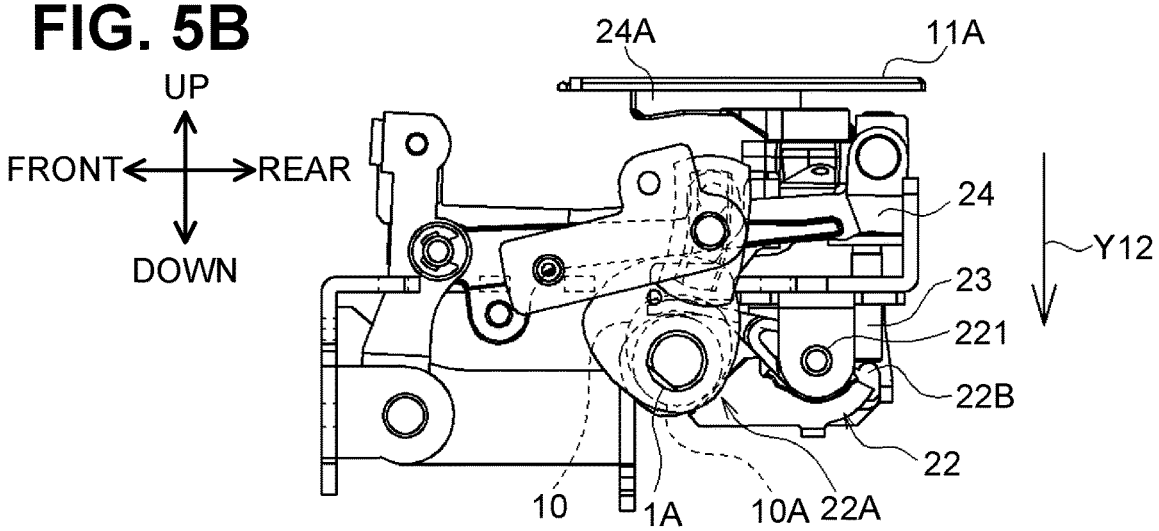
FIG. 5B is a view of the vertical drive mechanism when the sewing machine is in the active state.

Referring to FIGS. 5A and 5B, described below is operation of the vertical drive mechanism 2 when the lower shaft 1A is rotationally driven in a state where the second contact member 22A of the vertical feed contact 22 is in contact with the periphery of the second cam 10 (refer to FIG. 4). FIG. 5A shows a state where the large-diameter portion of the second cam 10 contacts the second contact member 22A as the lower shaft 1A rotates. In this case, the second contact member 22A of the vertical feed contact 22 moves in a direction away from the lower shaft 1A. The vertical feed contact 22 rotates, against an urging force of the second urging member, counterclockwise when viewed from the right. Upon receipt of a force from the contact portion 22B of the vertical feed contact 22, the vertical movement pin 23 moves up (as shown by an arrow Y11) against an urging force of the third urging member which urges down the feed stand 24. The feed stand 24 connected to the vertical movement pin 23 also moves up. This positions the feed dog 2A on the plate 24A above an upper surface of the needle plate 11A.

FIG. 5B shows a state where the small-diameter portion of the second cam 10 contacts the second contact member 22A as the lower shaft 1A rotates. In this case, the second contact member 22A of the vertical feed contact 22 moves in a direction toward the lower shaft 1A. The vertical feed contact 22 rotates, due to an urging force of the second urging member, clockwise when viewed from the right. As the contact portion 22B of the vertical feed contact 22 moves down, the vertical movement pin 23 moves down the feed stand 24 (as shown by an arrow Y12) due to an urging force of the third urging member. The feed stand 24 connected to the vertical movement pin 23 also moves down. This positions the feed dog 2A on the plate 24A below the upper surface of the needle plate 11A.

As described above, as the lower shaft 1A is rotationally driven in a state where the second contact member 22A is in contact with the periphery of the second cam 10, the vertical drive mechanism 2 drives the feed dog 2A by alternately switching the feed dog 2A above (refer to FIG. 5A) or below (refer to FIG. 5B) the upper surface of the needle plate 11A. Simultaneously, the front-rear feed mechanism (not shown) drives frontward and rearward the feed dog 2A which is driven vertically by the vertical drive mechanism 2. In a state where the feed dog 2A is located by the vertical drive mechanism 2 above the upper surface of the needle plate 11A, the front-rear feed mechanism drives the feed dog 2A frontward and rearward, thereby moving a workpiece.

Figure 5C:
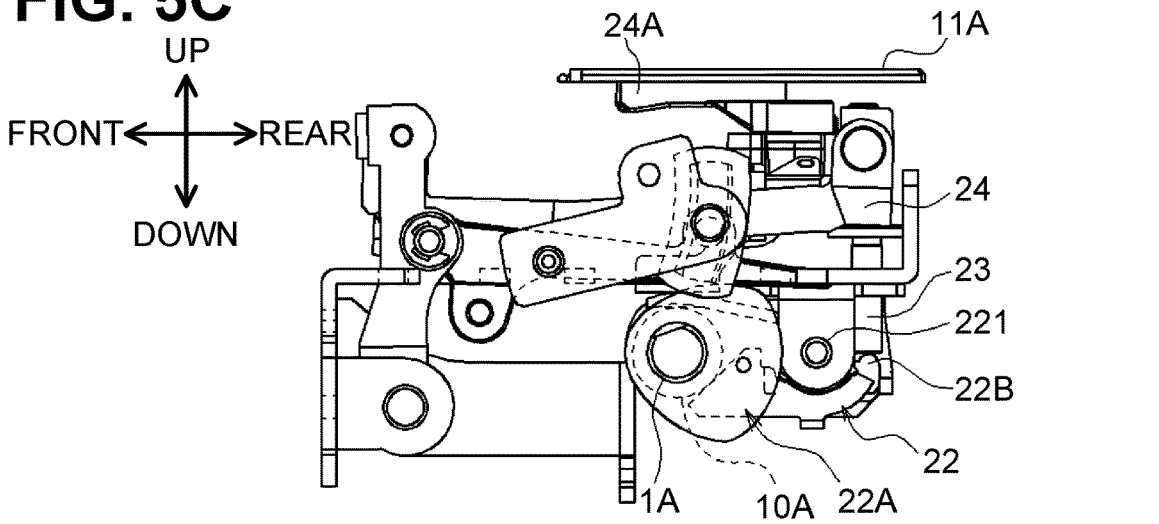
FIG. 5C is a view of the vertical drive mechanism when the sewing machine is in an inactive state.

Referring to FIG. 5C, described below is operation of the vertical drive mechanism 2 when the lower shaft 1A is rotationally driven in a state where the second contact member 22A of the vertical feed contact 22 is out of contact with the periphery of the second cam 10 (refer to FIG. 8). In this case, the second contact member 22A of the vertical feed contact 22 contacts the outer peripheral surface of the coupling 10A fixed to the lower shaft 1A. The second contact member 22A is maintained in a state shifted in a direction toward the lower shaft 1A. The vertical movement pin 23 is continuously located at a lower position due to an urging force of the third urging member which urges down the feed stand 24. The feed dog 2A disposed at the feed stand 24 connected to the vertical movement pin 23 is maintained in a state located below the upper surface of the needle plate 11A. In this case, the feed dog 2A does not move the workpiece.

Hereinafter, a state of the sewing machine 1 when the feed dog 2A is vertically driven by the vertical drive mechanism 2 to be above and below the upper surface of the needle plate 11A is referred to as an "active state". The active state indicates a state where a path for transmitting the rotational drive force of the lower shaft 1A to the vertical drive mechanism 2 (hereinafter referred to as a "transmission path for the rotational drive force of the lower shaft 1A) is connected by the second contact member 22A contacting the periphery of the second cam 10. On the other hand, a state of the sewing machine 1 where the feed dog 2A is maintained below the upper surface of the needle plate 11A is referred to as an "inactive state". The inactive state indicates a state where the transmission path for the rotational force of the lower shaft 1A is disconnected by the second contact member 22A out of contact with the periphery of the second cam 10.

Motor M and Gear Unit 6

As shown in FIGS. 2 and 4, the motor M is an actuator for driving the switch mechanism 3 and the cutting mechanism 5, which will be described later. The motor M is held in the bed 11 at a position further to the left than the vertical drive mechanism 2 and below the base plate 1B orthogonal to a vertical direction. As shown in FIGS. 6A to 6D, a rotation shaft Ma of the motor M extends upward beyond the base plate 1B. The gear unit 6 is disposed above the base plate 1B and rotates as the motor M rotates. The gear unit 6 includes a first gear 6A and second gears 6B and 6C. The first gear 6A and the second gears 6B and 6C are spur gears.

The first gear 6A is coupled to the rotation shaft Ma of the motor M and is driven to rotate by rotation of the motor M. The second gears 6B and 6C are rotatable about respective rotation shafts which extend upward from the base plate 1B. The second gear 6B is disposed in front of the first gear 6A. The second gear 6B meshes with the first gear 6A and rotates together with the first gear 6A. The second gear 6C is disposed obliquely at a rear right position relative to the second gear 6B. The second gear 6C meshes with the second gear 6B and rotates together with the second gear 6B. In other words, when the first gear 6A is driven to rotate by rotation of the motor M, the second gears 6B and 6C rotate together with the first gear 6A.

The second gear 6B includes, on its upper surface, a drive pin 66. The drive pin 66 is cylindrical and protrudes upward. The drive pin 66 is inserted, from below, into a guide groove 51A of a drive unit 5B of the cutting mechanism 5 to be described later. The drive pin 66 drives a guide unit 5A of the cutting mechanism 5 as the second gear 6C rotates.

Figure 7A:
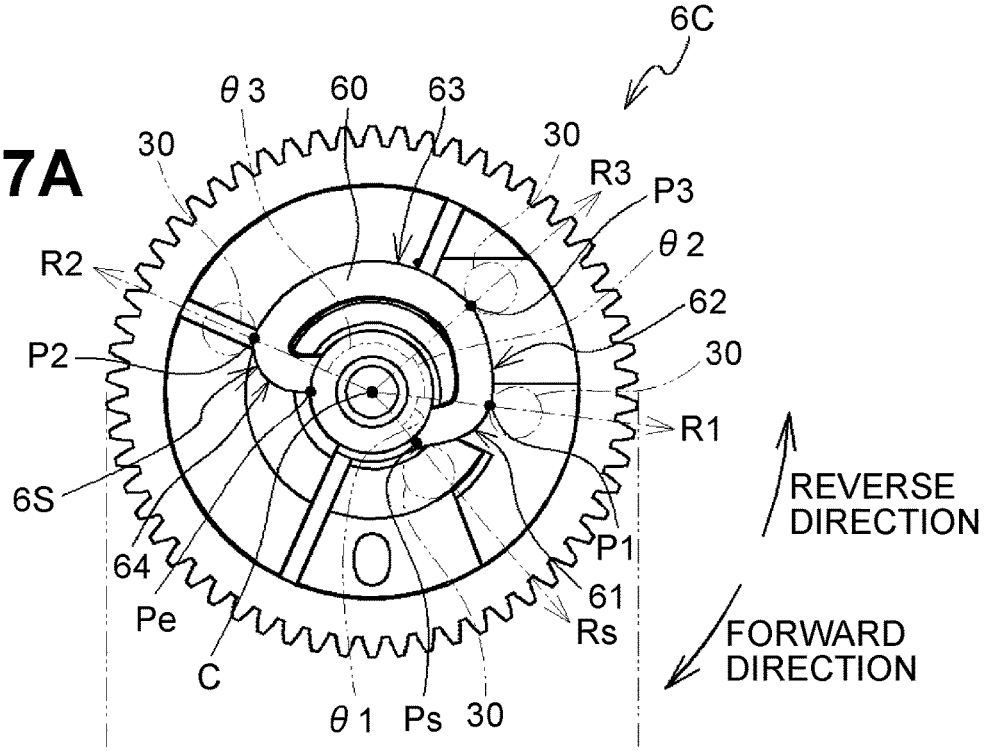
FIG. 7A is a view from below of a second gear.

As shown in FIG. 7A, the second gear 6C includes, on its lower surface, a first cam 60. The first cam 60 has a side surface 6S extending along an arc defined about an axis C which extends vertically. A first contact member 30 (refer to FIG. 4) of the switch mechanism 3 to be described later moves in contact with the side surface 6S as the second gear 6C is driven to rotate by rotation of the motor M. Hereinafter, for ease of explanation, rotation directions of the second gear 6C are defined as below. When viewed from below, a clockwise rotation of the second gear 6C is referred to as a "forward direction" and a counterclockwise rotation is referred to as a "reverse direction". A rotation direction of the motor M when the second gear 6C rotates in the forward direction is referred to as a "first direction" and a rotation direction of the motor M when the second gear 6C rotates in the reverse direction is referred to as a "second direction".

Contact positions Ps, P1, P2, P3, and Pe are defined as positions on the side surface 6S in a circumferential direction. The contact position Ps corresponds to an end of the side surface 6S in the forward direction. The contact position P1 is adjacent to the contact position Ps in the reverse direction. The contact position Pe corresponds to an end of the side surface 6S in the reverse direction. The contact position P2 is adjacent to the contact position Pe in the forward direction. The contact position P3 is offset in the forward direction from a midpoint between the contact positions P1 and P2. In other words, the contact position P3 is offset from the midpoint toward the contact position P1. The contact positions Ps, P1, P3, P2, and Pe are arranged in this order in the reverse direction. Line segments Rs, R1, R2, and R3 are defined to extend radially from the axis C of the second gear 6C and pass through the contact positions Ps, P1, P2, and P3, respectively. An angle between the line segments Rs and R1, an angle between the line segments R1 and R3, and an angle between the line segments R3 and R2 are designated as θ1, θ2, and θ3, respectively.

The shortest distances (hereinafter each referred to as a "radius") from the axis C to the contact positions Ps, P1, P2, P3, and Pe are designated as Ls, L1, L2, L3, and Le, respectively. The radius Ls at the contact position Ps and the radius Le at the contact position Pe are equal to each other (Ls=Le) and are less than the radius L1 at the contact position P1, the radius L2 at the contact position P2, and the radius L3 at the contact position P3 (Ls, Le<L1, L2, L3). The radius L2 of the side surface 6S at the contact position P2 and the radius L3 of the side surface 6S at the contact position P3 are equal to each other (L2=L3) and are greater than the radius L1 of the side surface 6S at the contact position P1 (L2, L3>L1).

When viewed from below the first cam 60, an arc extending along the side surface 6S between the contact positions Ps and P1, an arc extending between the contact positions P1 and P3, an arc extending between the contact positions P3 and P2, and an arc extending between the contact positions P2 and Pe are respectively referred to as an arc 61, an arc 62, an arc 63, and an arc 64. The radius of the arc 63 is defined between the contact positions P2 and P3 along a circle which is defined about the axis C and has the radius L2 or L3 (L2=L3). The radius of the arc 62, which extends from the contact position P3 to the contact position P1, gradually decreases from the radius L3 to the radius L1.

Figure 6A:
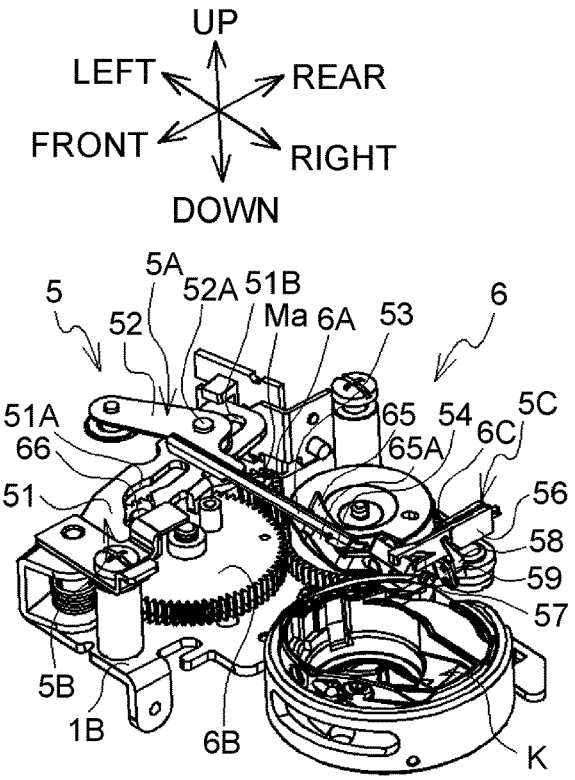
FIG. 6A is a perspective view of the cutting mechanism when the motor is in the initial state.
Figure 6B:
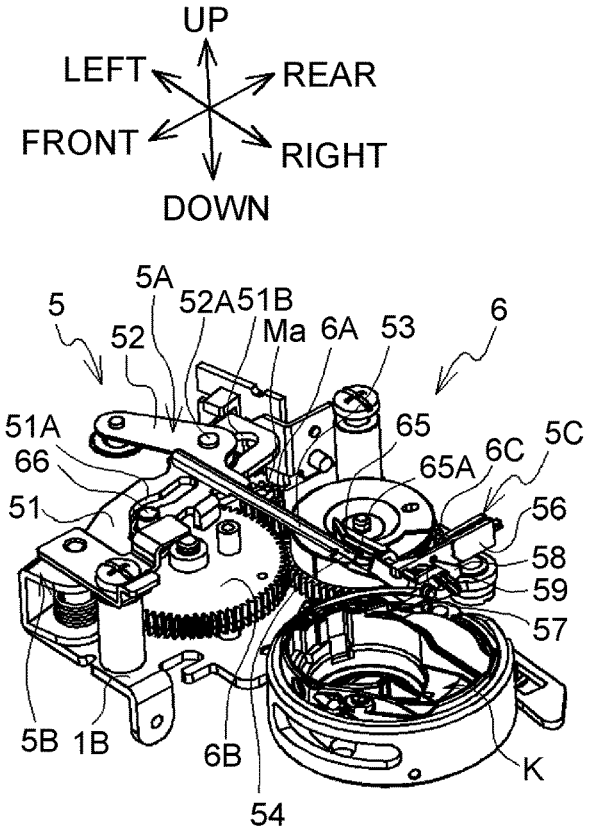
FIG. 6B is a perspective view of the cutting mechanism when the motor is in a first state.
Figure 6C:
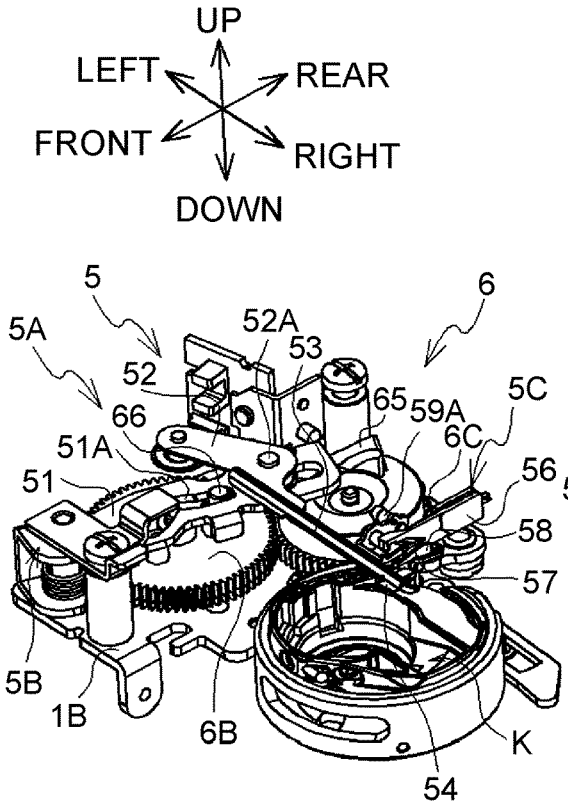
FIG. 6C is a perspective view of the cutting mechanism when the motor is in a second state.
Figure 6D:
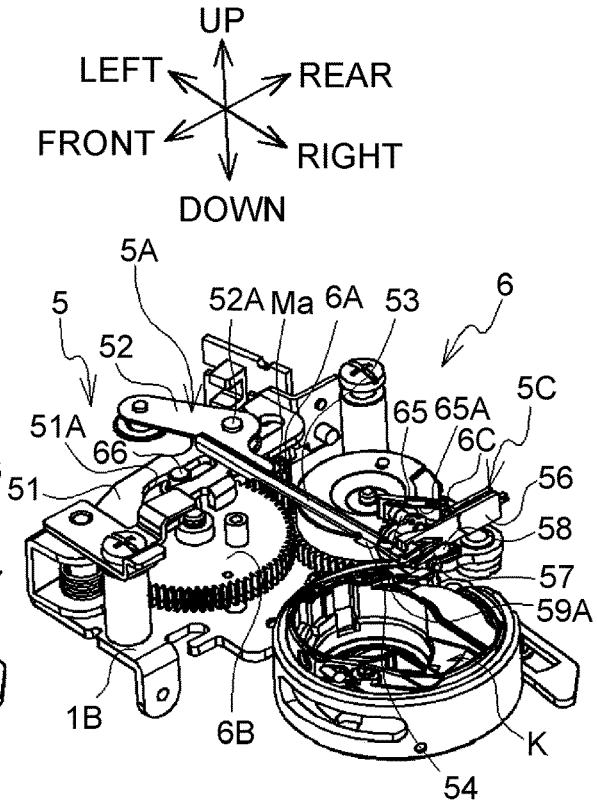
FIG. 6D is a perspective view of the cutting mechanism when the motor is in a third state.
Figure 7B:
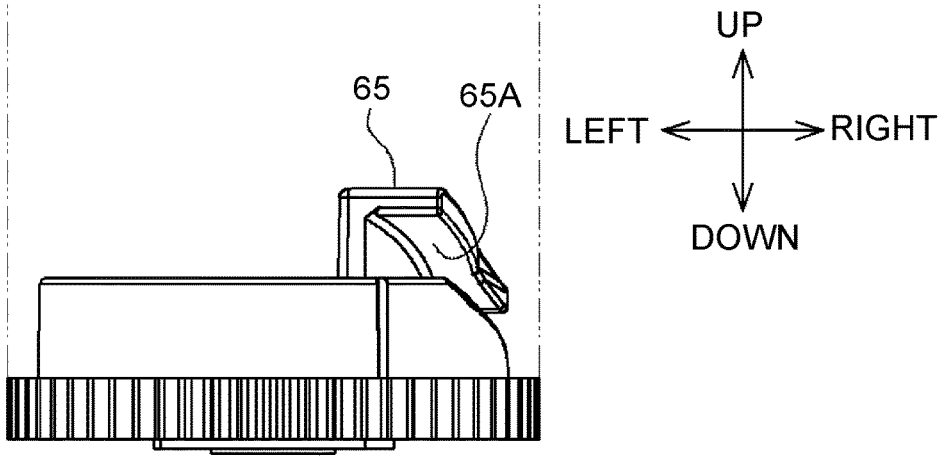
FIG. 7B is a side view of the second gear.

As shown in FIG. 7B, the second gear 6C includes, on its upper surface, a protrusion 65 protruding upward. The protrusion 65 has, along its outer peripheral surface, a guide groove 65A. As the second gear 6C rotates, the protrusion 65 drives a cutter 5C (refer to FIGS. 6A to 6D) of the cutting mechanism 5 to be described later.

Switch Mechanism 3

The switch mechanism 3 switches the sewing machine 1 from the active state to the inactive state. As shown in FIG. 4, the switch mechanism 3 includes plate members 3A and 3B and the first contact member 30. The plate members 3A and 3B are each disposed below the base plate 1B. The plate members 3A and 3B are each shaped like an elongate plate and orthogonal to the vertical direction.

The plate member 3A is disposed opposite to the second gear 6C relative to the base plate 1B and extends in the front-rear direction. A rotation shaft 31 extends downward from the base plate 1B and is inserted in a hole (not shown) at a front end of the plate member 3A. The plate member 3A is supported rotatably about the rotation shaft 31 relative to the base plate 1B. A fourth urging member 36 (refer to FIG. 8) is disposed between the plate member 3A and the base plate 1B. The fourth urging member 36 is a tension spring. One end of the fourth urging member 36 is connected to a center of the plate member 3A in an extending direction. The other end of the fourth urging member 36 is connected to the base plate 1B. The fourth urging member 36 applies to the plate member 3A a counterclockwise force when viewed from below to urge the plate member 3A. A rotation shaft 32 extending vertically is inserted in a hole (not shown) at a rear end of the plate member 3A.

The plate member 3A includes, on its upper surface, the first contact member 30. The first contact member 30 is cylindrical and penetrates a hole (not shown) in the base plate 1B to extend upward. A side surface of the first contact member 30 contacts, from the right, the side surface 6S (refer to FIG. 7A) of the first cam 60 (refer to FIG. 7A) of the second gear 6C. The fourth urging member 36 applies an urging force to the plate member 3A such that the first contact member 30 moves toward the first cam 60 (leftward). Thus, the first contact member 30 is pushed, due to an urging force of the fourth urging member 36, from the right against the side surface 6S of the first cam 60. As the second gear 6C rotates, the first contact member 30 contacts the side surface 6S of the first cam 60 in turn at a different one of contact positions in the circumferential direction. In addition, the radius of the side surface 6S changes correspondingly. Thus, the first contact member 30 moves in the left-right direction as the radius of the side surface 6S changes with change of the location of a contact position in response to rotation of the second gear 6C.

The plate member 3B is disposed to the left of the vertical feed contact 22 of the vertical drive mechanism 2 and extends in the left-right direction. The rotation shaft 32 is inserted in a hole (not shown) at a left end of the plate member 3B. The plate member 3B is rotatably coupled to the plate member 3A via the rotation shaft 32. The plate member 3B has a slot 33 elongate in the left-right direction. A shaft 35 extending downward from the base plate 1B is inserted in the slot 33 and restricts the plate member 3B from moving in the left-right direction. The right end 34 of the plate member 3B is located adjacent to and to the left of a left surface of the vertical feed contact 22.

Operation of Switch Mechanism 3

FIG. 4 shows a state of the switch mechanism 3 when the first contact member 30 is in contact, at the contact position Ps shown in FIG. 7A, with the first cam 60 of the second gear 6C. In this case, the right end 34 of the plate member 3B is located slightly to the left of the left surface of the vertical feed contact 22 of the vertical drive mechanism 2. There is a clearance between the right end 34 of the plate member 3B and the left surface of the vertical feed contact 22. In this case, the vertical feed contact 22 moves to the leftmost position, due to an urging force of the first urging member (not shown), such that the second contact member 22A contacts the periphery of the second cam 10. Upon contact of the second contact member 22A with the periphery of the second cam 10, the transmission path for the rotational drive force of the lower shaft 1A is connected, thereby bringing the sewing machine 1 into the active state. Hereinafter, a state of the motor M when the first contact member 30 is in contact, at the contact position Ps, with the first cam 60 is referred to as an "initial state".

As the motor M rotates in the first direction from the initial state, the second gear 6C rotates in the forward direction. As shown in FIG. 7A, the first contact member 30 moves in contact with the side surface 6S of the first cam 60 from the contact position Ps toward the contact position P1. The radius of the first cam 60 at a contact position with the first contact member 30 gradually increases from Ls with change of the location of a contact position where the first contact member 30 contacts the first cam 60. Upon receipt of a rightward force from the first cam 60, the first contact member 30 moves rightward against a force of the fourth urging member 36. This causes the plate member 3B to move rightward. However, a state where a clearance is defined between the right end 34 of the plate member 3B and the left surface of the vertical feed contact 22 is maintained until the first contact member 30 contacts, at the contact position P1, with the first cam 60. Thus, a state where the second contact member 22A of the vertical drive mechanism 2 is in contact with the periphery of the second cam 10 is maintained. This causes the transmission path for the rotational drive force of the lower shaft 1A to be continuously connected. The sewing machine 1 is thus maintained in the active state.

Figure 8A:
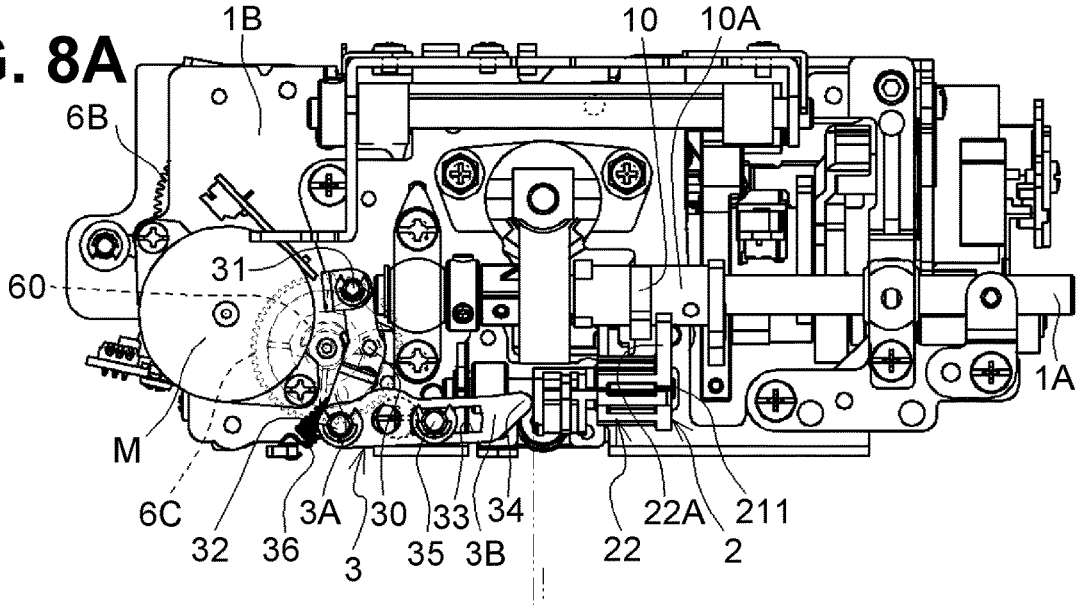
FIG. 8A is a view from below of the vertical drive mechanism and the switch mechanism when the motor is in the first state.

FIG. 8A shows a state of the switch mechanism 3 when the first contact member 30 is in contact, at the contact position P1 shown in FIG. 7A, with the first cam 60. The radius of the first cam 60 at the contact position P1 with the first contact member 30 is L1. As the first contact member 30 moves rightward upon receipt of a rightward force from the first cam 60, the right end 34 of the plate member 3B contacts and pushes the left surface of the vertical feed contact 22. The vertical feed contact 22 moves rightward against a force of the first urging member (not shown) such that the second contact member 22A moves to a position to the right of the second cam 10. The second contact member 22A gets out of contact with the periphery of the second cam 10 and contacts a portion of the outer peripheral surface of the coupling 10A, the portion being further to the right than the second cam 10. The transmission path for the rotational drive force of the lower shaft 1A is disconnected, thereby bringing the sewing machine 1 into the inactive state. Hereinafter, a state of the motor M when the first contact member 30 is in contact, at the contact position P1, with the first cam 60 is referred to as a "first state". The difference in angle of the rotation shaft Ma between when the motor M is in the initial state and when the motor M is in the first state is referred to as a "first angle". The motor M rotates by the first angle in the first direction when the second gear 6C rotates by an angle of θ1 in the forward direction from a state where the first contact member 30 is in contact, at the contact position Ps, with the first cam 60 to a state where the first contact member 30 is in contact, at the contact position P1, with the first cam 60.

As the motor M rotates further in the first direction from the first state, the second gear 6C rotates further in the forward direction. The first contact member 30 moves in contact with the side surface 6S of the first cam 60, as shown in FIG. 7A, from the contact position P1 toward the contact position P3. The radius of the first cam 60 at a contact position with the first contact member 30 gradually increases from L1 to L3 with change of the location of a contact position where the first contact member 30 contacts the first cam 60. Upon receipt of a rightward force from the first cam 60, the first contact member 30 moves further rightward against a force of the fourth urging member 36. Upon receipt of a force from the plate member 3B of the switch mechanism 3, the vertical feed contact 22 of the vertical drive mechanism 2 moves further rightward against an urging force of the first urging member (not shown). A state where the second contact member 22A is out of contact with the second cam 10 is maintained. This causes the transmission path for the rotational drive force of the lower shaft 1A to be continuously disconnected. The sewing machine 1 is maintained in the inactive state. Hereinafter, a state of the motor M when the first contact member 30 is in contact, at the contact position P3, with the first cam 60 is referred to as a "third state". The difference in angle of the motor shaft Ma between when the motor M is in the first state and when the motor M is in the third state is referred to as a "third angle". The motor M rotates by the third angle in the first direction when the second gear 6C rotates by an angle of θ2 in the forward direction from a state where the first contact member 30 is in contact, at the contact position P1, with the first cam 60 to a state where the first contact member 30 is in contact, at the contact position P3, with the first cam 60.

As the motor M rotates further in the first direction from the third state, the second gear 6C rotates further in the forward direction. The first contact member 30 moves in contact with the side surface 6S of the first cam 60 from the contact position P3 toward the contact position P2. In this case, the radius of the first cam 60 at either contact position with the first contact member 30 is constantly maintained at L2 and L3 (L2=L3).

Figure 8B:
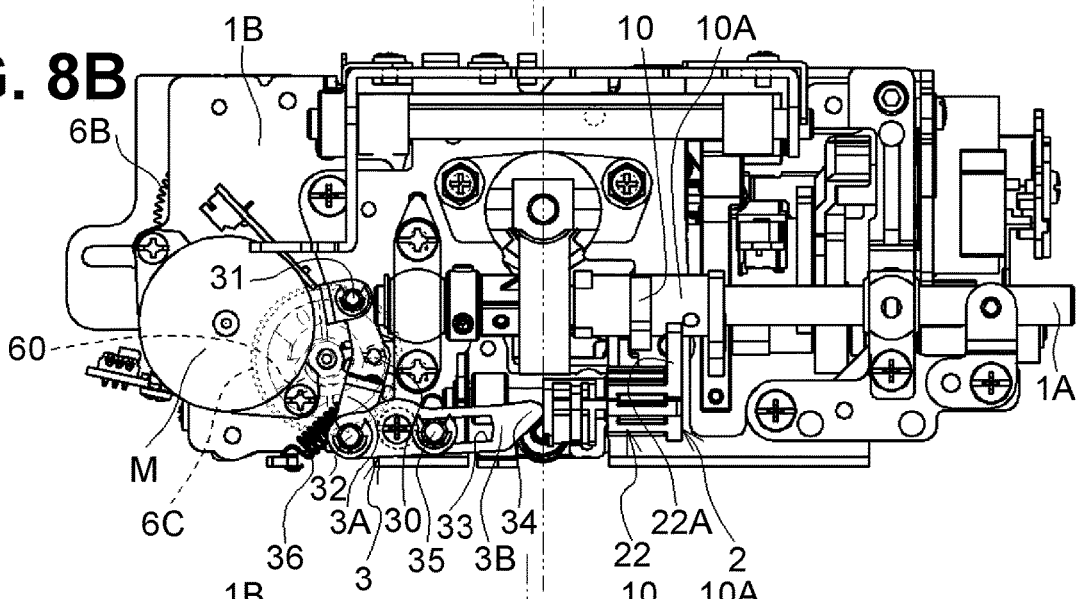
FIG. 8B is a view from below of the vertical drive mechanism and the switch mechanism when the motor is in the second state.

FIG. 8B shows a state of the switch mechanism 3 when the first contact member 30 is in contact, at the contact position P2 shown in FIG. 7A, with the first cam 60. The radius of the first cam 60 at the contact position P2 with the first contact member 30 is L2. A state where the second contact member 22A is out of contact with the periphery of the second cam 10 is maintained. This causes the transmission path for the rotational drive force of the lower shaft 1A to be continuously disconnected. The sewing machine 1 is thus maintained in the inactive state. Hereinafter, a state of the motor M when the first contact member 30 is in contact, at the contact position P2, with the first cam 60 is referred to as a "second state". The difference in angle of the motor shaft Ma between when the motor M is in the second state and when the motor M is in the third state is referred to as a "fourth angle". The motor M rotates by the fourth angle in the first direction when the second gear 6C rotates by an angle of θ3 in the forward direction from a state where the first contact member 30 is in contact, at the contact position P3, with the first cam 60 to a state where the first contact member 30 is in contact, at the contact position P2, with the first cam 60. A value obtained by adding the third angle and the fourth angle is referred to as a "second angle". The motor M rotates by the second angle in the first direction when the second gear 6C rotates by an angle of θ2+θ3 in the forward direction from a state where the first contact member 30 is in contact, at the contact position P1, with the first cam 60 to a state where the first contact member 30 is in contact, at the contact position P2, with the first cam 60.

Subsequently, as the motor M rotates in the second direction from the second state, the second gear 6C rotate in the reverse direction. As the motor M rotates in the second direction by the first angle plus the second angle (which is equal to the third angle plus the fourth angle) to return to the initial position, the first contact member 30 moves in contact with the side surface 6S of the first cam 60 shown in FIG. 7(A) from the contact position P2, via the contact positions P3 and P1, to the contact position Ps. The radius of the first cam 60 at a contact position with the first contact member 30 is constantly maintained at L2 and L3, and then gradually decreases to L1 and further to Ls. The first contact member 30 moves leftward in contact with the side surface 6S of the first cam 60, due to an urging force of the fourth urging member 36, and the plate member 3B also moves leftward. Thus, the vertical feed contact 22 also moves leftward due to an urging force of the first urging member. When the vertical feed contact 22 moves leftward, the left surface of the second contact member 22A contacts, from the right, a right surface of the second cam 10. The vertical feed contact 22 is restricted from moving leftward by the second contact member 22A in contact with the right surface of the second cam 10. In a state where the second contact member 22A is out of contact with the periphery of the second cam 10, a clearance is defined between the right end 34 of the plate member 3B and the left surface of the vertical feed contact 22.

Figure 8C:
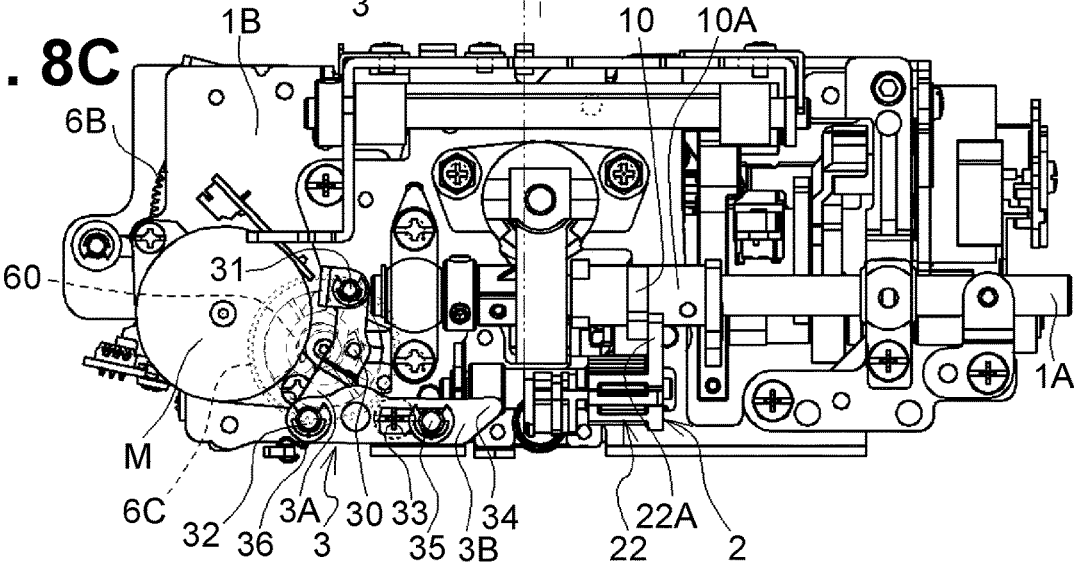
FIG. 8C is a view from below of the vertical drive mechanism and the switch mechanism when the motor is in the initial state.

FIG. 8C shows a state of the switch mechanism 3 when the first contact member 30 is in contact, at the contact position Ps shown in FIG. 7A, with the first cam 60. Even when the motor M returns to the initial state, the transmission path for the rotational drive force of the lower shaft 1A is maintained disconnected. This causes the sewing machine 1 to be maintained in the inactive state.

As the sewing machine 1 starts sewing, the lower shaft 1A rotates such that the second contact member 22A moves in contact with the outer peripheral surface of the coupling 10A from a position to the right of the large-diameter peripheral portion of the second cam 10 to a position to the right of the small-diameter peripheral portion. The second contact member 22A gets out of contact with the right surface of the second cam 10. The distance from the axis of the lower shaft 1A to the small-diameter peripheral portion of the second cam 10 is equal to the distance from the axis of the lower shaft 1A to the outer peripheral surface of the coupling 10A. This allows the vertical feed contact 22 to move leftward, due to an urging force of the first urging member, until the second contact member 22A contacts the small-diameter peripheral portion of the second cam 10. The transmission path for the rotational drive force of the lower shaft 1A is connected by the second contact member 22A contacting the periphery of the second cam 10. The sewing machine 1 returns to the active state (refer to FIG. 4) from the inactive state.

Cutting Mechanism 5

Figure 3:
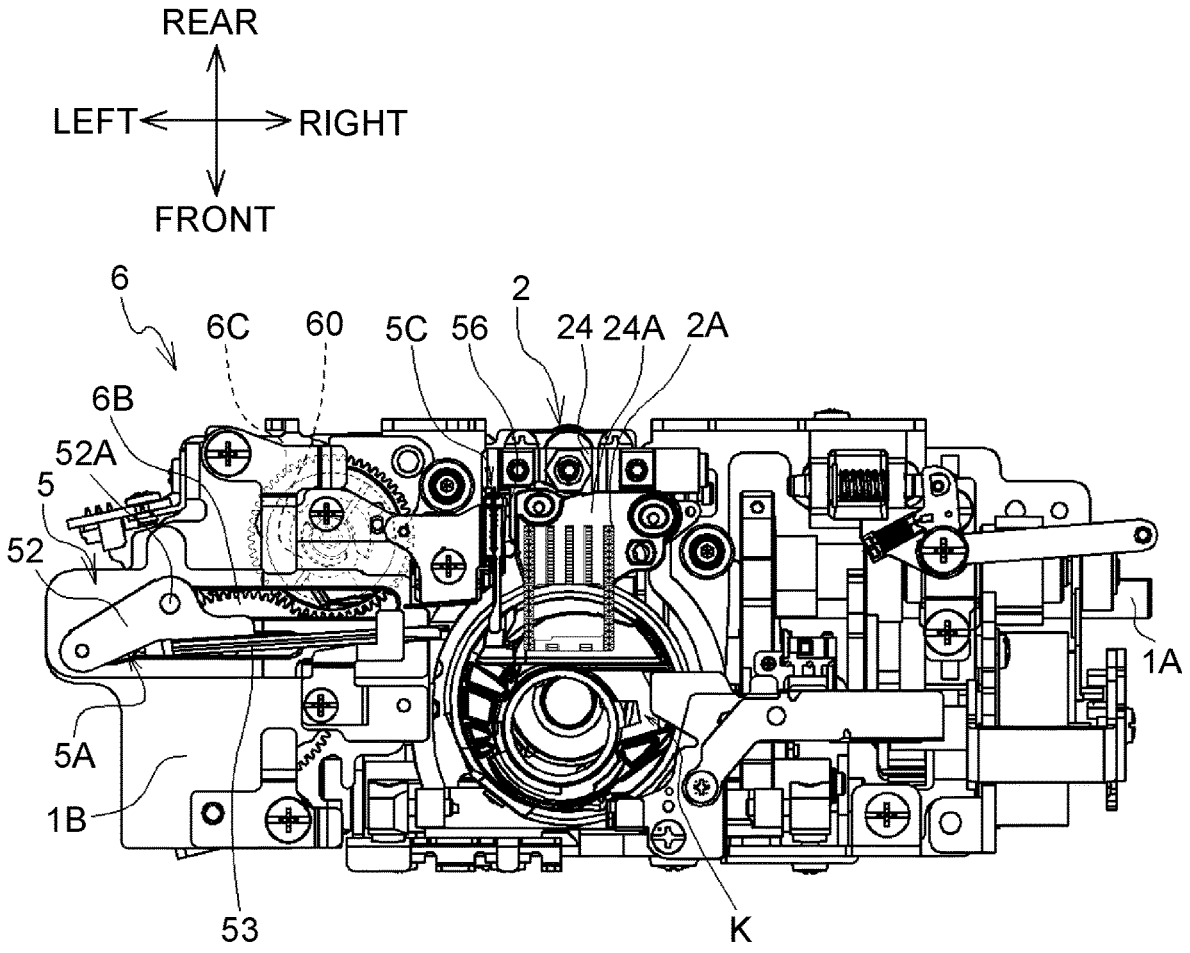
FIG. 3 is a view from above of the vertical drive mechanism, the cutting mechanism, and the gear unit.

The cutting mechanism 5 is a known mechanism for cutting a thread below the needle plate 11A. An example of the cutting mechanism 5 is described, for example, in Japanese Laid-Open Patent Publication No. 2009-183537, and therefore will be briefly described below. As shown in FIGS. 2 and 3, the cutting mechanism 5 is held at the base plate 1B and includes the guide unit 5A, the drive unit 5B (refer to FIGS. 6A to 6D), and the cutter 5C. The guide unit 5A is disposed further to the left than the shuttle mechanism K and the feed dog 2A in the left-right direction. The drive unit 5B is disposed below the guide unit 5A. The cutter 5C is disposed between the guide unit 5A and the shuttle mechanism K in the left-right direction.

As shown in FIGS. 6A to 6D, the drive unit 5B drives, due to a rotational drive force of the second gear 6B, the guide unit 5A to be described later. The drive unit 5B includes a lever 51. The lever 51 has an elongate plate shape and is orthogonal to the vertical direction. The lever 51 extends in the front-rear direction. A front end of the lever 51 is rotatably supported relative to the base plate 1B. The lever 51 has guide grooves 51A and 51B which are slots extending in the front-rear direction. The drive pin 66 on the upper surface of the second gear 6B is inserted, from below, in the guide groove 51A. In response to the drive pin 66 moving along the guide groove 51A as the second gear 6B is driven to rotate, the lever 51 rotates about its front end. A drive pin 52A of the guide unit 5A to be described later is inserted, from above, in the guide groove 51B.

The guide unit 5A is driven by the drive unit 5B. The guide unit 5A includes a base 52, an extending portion 53, and a first thread catcher 54. The first thread catcher 54 of the guide unit 5A, which is located below the needle plate 11A (refer to FIG. 1) and above the shuttle mechanism K, catches a thread and guides it leftward, as described later.

The base 52 has an elongate plate shape and is orthogonal to the vertical direction. The base 52 extends in the left-right direction. A left end of the base 52 is movably supported in the left-right direction relative to the base plate 1B. The base 52 includes, at its right end, the cylindrical drive pin 52A. The drive pin 52A extends downward from a lower surface of the base 52 and is inserted, from above, in the guide groove 51B of the lever 51. As the lever 51 is driven to rotate, the drive pin 52A moves along the guide groove 51B. This causes the base 52 to move in the left-right direction.

The extending portion 53 has a rod shape and extends in the left-right direction. A left end of the extending portion 53 is connected to the right end of the base 52. The extending portion 53 extends from the connected portion to the base 52 rightward to a position above the shuttle mechanism K. The extending portion 53 includes, at its right end, the first thread catcher 54. The first thread catcher 54 has a hook shape and protrudes downward. As the base 52 moves in the left-right direction by the rotationally driven lever 51, the first thread catcher 54 moves in the left-right direction above the shuttle mechanism K.

The cutter 5C is driven by the protrusion 65 of the second gear 6C. The cutter 5C includes a cover 56, a blade 57, a second thread catcher 58, and a holder 59. In the cutter 5C, the second thread catcher 58 catches the thread guided by the guide unit 5A and the blade 57 cuts the thread.

The cover 56 extends in the front-rear direction and has, at its front end, a cutout. The cutout is located above the shuttle mechanism K. The blade 57 is held at the front end of the cover 56. The blade 57 is exposed through the cutout of the cover 56. The second thread catcher 58 includes two elongate plates. One end of each of the two plates has a hook shape. The two plates face each other in the left-right direction. Hereinafter, the one end of each of the two plates is referred to as a "hooked end".

The holder 59 holds, at a position below the cover 56, the other end of each of the two plates of the second thread catcher 58. Hereinafter, the other end of each of the two plates is referred to as a "rotation end". The holder 59 includes a link mechanism 59A extending leftward. A left end of the link mechanism 59A is inserted, from the left, in the guide groove 65A at the protrusion 65 of the second gear 6C. As the left end moves along the guide groove 65A by the rotationally driven second gear 6C, the link mechanism 59A rotates the holder 59 about a rotation shaft extending in the left-right direction. As the holder 59 rotates, the two plates of the second thread catcher 58 held by the holder 59 rotate about the rotational ends. A fifth urging member (not shown) urges the second thread catcher 58 clockwise when viewed from the right. Hereinafter, rotation directions (clockwise and counterclockwise) of the second thread catcher 58 are defined when viewed from the right unless otherwise specified.

Operation of Cutting Mechanism 5

FIG. 6A shows a state of the cutting mechanism 5 when the first contact member 30 is in contact, at the contact position Ps shown in FIG. 7A, with the first cam 60. In this case, the motor M is in the initial position. The sewing machine 1 is in the active state (refer to FIG. 4) where the feed dog 2A is driven above and below the upper surface of the needle plate 11A as the lower shaft 1A is driven to rotate. The feed dog 2A thus moves a workpiece. In this state, the guide unit 5A is located at the leftmost position within a movable range in the left-right direction. In this case, the first thread catcher 54 of the guide unit 5A is disposed further to the left than the blade 57 of the cutter 5C in the left-right direction. The second thread catcher 58 of the cutter 5C is fully rotated clockwise within a rotatable range.

The two plates of the second thread catcher 58 extend upward from the rotation ends toward the hooked ends, and are located on left and right sides of the cover 56.

As the motor M rotates in the first direction from the initial state, the second gear 6B rotates. In this case, the guide unit 5A is driven by the drive unit 5B to move rightward. As the motor M rotates in the first direction, the second gear 6C rotates in the forward direction. The first contact member 30 moves in contact with the side surface 6S shown in FIG. 7A of the first cam 60 from the contact position Ps toward the contact position P1. In this case, the link mechanism 59A of the cutter 5C moves along the guide groove 65A of the second gear 6C to rotate the holder 59. This causes the second thread catcher 58 to rotate counterclockwise.

FIG. 6B shows a state of the cutting mechanism 5 when the first contact member 30 is in contact, at the contact position P1 shown in FIG. 7A, with the first cam 60. In this case, the motor M is in the first state. The sewing machine 1 is in the inactive state (refer to FIG. 8A) where the feed dog 2A is maintained below the upper surface of the needle plate 11A. In this state, the first thread catcher 54 of the guide unit 5A moves closer to a position to the left of the blade 57 of the cutter 5C. The two plates of the second thread catcher 58 extend from the rotation ends toward the hooked ends obliquely upward toward the front.

As the motor M rotates further in the first direction from the first state, the second gear 6B rotates further. In this case, the guide unit 5A is driven by the drive unit 5B to move further rightward. As the motor M rotates in the first direction, the second gear 6C rotates further in the forward direction. The first contact member 30 moves in contact with the side surface 6S of the first cam 60 shown in FIG. 7A from the contact position P1 to the contact position P2. In this case, the link mechanism 59A of the cutter 5C moves along the guide groove 65A of the second gear 6C to rotate the holder 59. This causes the second thread catcher 58 to rotate counterclockwise.

FIG. 6C shows a state of the cutting mechanism 5 when the first contact member 30 is in contact, at the contact position P2 shown in FIG. 7A, with the first cam 60. In this case, the motor M is in second state. The sewing machine 1 is in the inactive state (refer to FIG. 8B) where the feed dog 2A is maintained below the upper surface of the needle plate 11A. In this state, the first thread catcher 54 of the guide unit 5A is located further to the right than the blade 57 of the cutter 5C in the left-right direction. This allows the first thread catcher 54 to catch a thread extending from the shuttle mechanism K. The two plates of the second thread catcher 58 extend horizontally from the rotation ends toward the hooked ends, and are located below the blade 57.

Subsequently, as the motor M rotates in the second direction from the second state, the second gear 6B rotates. In this case, the guide unit 5A is driven by the drive unit 5B to move leftward. When the first thread catcher 54 has caught a thread, the thread is guided leftward as the guide unit 5A moves. FIG. 6D shows a state of the cutting mechanism 5 when the first contact member 30 is in contact, at the contact position P3 shown in FIG. 7A, with the first cam 60. In this case, the motor M is in the third state. The sewing machine 1 is in the inactive state where the feed dog 2A is maintained below the upper surface of the needle plate 11A. In this state, the first thread catcher 54 of the guide unit 5A is located further to the left than the blade 57 of the cutter 5C in the left-right direction. As the motor M rotates in the second direction from the second state to the third state, the second gear 6C rotate in the reverse direction. However, the two plates of the second thread catcher 58 extend horizontally from the rotation ends toward the hooked ends, and are maintained below the blade 57.

As the motor M rotates further in the second direction from the third state, the second gear 6B rotates further. In this case, the guide unit 5A is driven by the drive unit 5B to move further leftward. When the first thread catcher 54 has caught a thread, the thread is guided leftward as the guide unit 5A moves. As the motor M rotates in the second direction, the second gear 6C rotates further in the reverse direction. As shown in in FIGS. 4 and 8A to 8C, the first contact member 30 is pushed from the right to the first cam 60 of the second gear 6C, due to an urging force applied by the fourth urging member 36 to the plate member 3A of the switch mechanism 3. The radius of the arc 62 (refer to FIG. 7A) gradually decreases from the contact position P3 toward the contact position P1 to be from the radius L3 to the radius L1. Thus, a force in the reverse direction is applied to the second gear 6C, corresponding to a force received by the first cam 60 from the first contact member 30. The force in the reverse direction corresponds to the second direction in which the motor M rotates. In other words, an urging force of the fourth urging member 36 acts on the motor M as a force for rotating the motor M in the second direction, thereby increasing a rotation torque of the motor M. As the second gear 6C rotates, the link mechanism 59A of the cutter 5C moves along the guide groove 65A of the second gear 6C to rotate the holder 59. This causes the second thread catcher 58 to rotate clockwise.

As shown in FIG. 6B, when the motor M becomes the first state and the first contact member 30 moves to the contact position P1 shown in FIG. 7A with the first cam 60, the two plate members of the second thread catcher 58 rotate so as to extend from the rotation ends toward the hooked ends obliquely upward toward the front. When the first thread catcher 54 has caught a thread and the thread has been guided leftward, the second thread catcher 58 catches from below the thread and guides it upward. The second thread catcher 58 cuts the thread by pressing the thread to the blade 57.

When the motor M rotates further in the second direction from the first state to the initial state (refer to FIG. 6A), the first contact member 30 contacts, at the contact position Ps shown in FIG. 7A, with the first cam 60. The motor M returns to the initial state. However, the sewing machine 1 is maintained in the inactive state (refer to FIG. 8C) where the feed dog 2A is maintained below the upper surface of the needle plate 11A. When the lower shaft 1A rotates as the sewing machine 1 starts sewing, the transmission path for the rotational drive force of the lower shaft 1A is connected by the second contact member 22A contacting the periphery of the second cam 10. The sewing machine 1 thus returns to the active state (refer to FIG. 4) from the inactive state.

Effects in the Illustrative Embodiment

The sewing machine 1 includes the switch mechanism 3 and the cutting mechanism 5. The switch mechanism 3 switches from the active state (refer to FIG. 4) where the feed dog 2A is driven above and below the upper surface of the needle plate 11A to the inactive state (refer to FIGS. 8A to 8C) where the upper surface of the feed dog 2A is maintained below the upper surface of the needle plate 11A. The blade 57 of the cutting mechanism 5 cuts a thread. The motor M, which is a common actuator, drives the switch mechanism 3 and the cutting mechanism 5. In the sewing machine 1, the common drive source drives the mechanism for cutting the thread and the mechanism for maintaining the state where the feed dog 2A is located below the needle plate 11A.

When the sewing machine 1 is in the active state, the transmission path for the rotational force of the lower shaft 1A is connected and the vertical drive mechanism 2 vertically drives the feed dog 2A. At the same time, the rotationally driven lower shaft 1A drives the front-rear feed mechanism (not shown) which in turn drives the feed dog 2A in the front-rear direction. This enables the sewing machine 1 to move the workpiece. In contrast, when the sewing machine 1 is in the inactive state, the transmission path for the rotational drive force of the lower shaft 1A is disconnected and the feed dog 2A is maintained below the upper surface of the needle plate 11A. The switch mechanism 3 switches the swing machine 1 from the active state to the inactive state by switching the transmission path for the rotational drive force of the lower shaft 1A from the connected state to the disconnected state. When the sewing machine 1 is in the inactive state, the blade 57 of the cutting mechanism 5 cuts the thread guided by the first thread catcher 54 and the second thread catcher 58. In short, in the sewing machine 1, the cutting mechanism 5 cuts the thread in a state where the vertical drive mechanism 2 is restricted by the switch mechanism 3 from moving the workpiece. This allows the common motor M to drive the mechanism (switch mechanism 3) for switching the sewing machine 1 from the active state to the inactive state, and the mechanism (cutting mechanism 5) for cutting the thread.

While the motor M rotates from the initial state in the first direction by the first angle, the transmission path for the rotational drive force of the lower shaft 1A stays connected (refer to FIG. 4). When the motor M is brought into the first state after rotating from the initial state in the first direction by the first angle, the motor M drives the switch mechanism 3 to switch the transmission path for the rotational drive force of the lower shaft 1A from connected to disconnected (refer to FIG. 8A). While the motor M rotates from the first state to the second state in the first direction by the second angle and then rotates from the second state to the initial state in the second direction, the transmission path for the rotational force of the lower shaft 1A is maintained disconnected (refer to FIGS. 8B and 8C). While the motor M rotates from the third state to the first state in the second direction by the third angle, the motor M drives the cutting mechanism 5 to cut the thread (refer to FIGS. 6D and 6B). In this case, in the sewing machine 1, the motor M rotating in the first direction or in the second direction drives the switch mechanism 3 and the cutting mechanism 5. In the sewing machine 1, the thread is cut after the feed dog 2A is switched from a state unable to move the workpiece to a state able to move the workpiece. In the sewing machine 1, the switch mechanism 3 and the cutting mechanism 5 are controlled to be timely driven respectively in correspondence with the rotation directions and the rotation angles of the motor M.

The sewing machine 1 includes the gear unit 6 rotatable as the motor M rotates, the first cam 60, the second contact member 22A contactable with the first cam 60. The cutting mechanism 5 is driven, in response to rotation of the gear unit 6, to cut the thread. Upon movement of the first contact member 30 as the first cam 60 rotates, the switch mechanism 3 switches the transmission path for the rotational drive force of the lower shaft 1A from connected to disconnected. In this case, in the sewing machine 1, the rotational drive force of the motor M is transmitted, via different paths, to the switch mechanism 3 and the cutting mechanism 5 which are thus driven. Thus, in the sewing machine 1, the common motor M readily drives the switch mechanism 3 and the cutting mechanism 5.

The gear unit 6 includes the first gear 6A coupled to the rotation shaft Ma of the motor M, and the second gears 6B and 6C rotatable as the first gear 6A rotates. The second gear 6C includes the first cam 60. The cutter 5C of the cutting mechanism 5 is driven, in response to rotation of the second gear 6C, to cut a thread. Upon rotation of the first cam 60 as the second gear 6C rotates, the first contact member 30 of the switch mechanism 3 moves to switch the transmission path for the rotational drive force of the lower shaft 1A from connected to disconnected. In this case, in the sewing machine 1, the switch mechanism 3 is driven via the first cam 60 which is disposed at the second gear 6C to directly drive the cutter 5C of the cutting mechanism 5. Thus, in the sewing machine 1 including the cutting mechanism 5 to be driven by the motor M, the switch mechanism 3 to be driven by the motor M is readily achieved, for example, by providing the first cam 60 for the second gear 6C. The sewing machine 1 is thus readily achieved where the common motor M drives the switch mechanism 3 and the cutting mechanism 5.

The sewing machine 1 includes the fourth urging member 36 connected to the plate member 3A of the switch mechanism 3. The fourth urging member 36 urges in a direction in which the motor M rotates in the second direction. In this case, a torque is applied to the motor M when the motor M rotates in the second direction. In the sewing machine 1, a rotation torque of the motor M increases when the motor M drives the cutting mechanism 5 while rotating in the second direction from the third state to the first state. This enables the cutting mechanism 5 of the sewing machine 1 to appropriately cut a thread. The radius of the arc 62 extending between the contact position P1 and the contact position P3 along the side surface 6S of the first cam 60 gradually decreases from the contact position P3 toward the contact position P1. In this case, in the sewing machine 1, the fourth urging member 36 effectively applies a torque to the motor M when the first contact member 30 moves in contact with the first cam 60 from the contact position P3 to the contact position P1. In the sewing machine 1, a rotation torque of the motor M increases when the motor M drives the cutting mechanism 5 to cut a thread, thereby enabling the cutting mechanism 5 to appropriately cut the thread.

The vertical drive mechanism 2 is switched between a state where the second contact member 22A is in contact with the second cam 10 at the lower shaft 1A and a state where the second contact member 22A is out of contact with the second cam 10. The switch mechanism 3 switches the sewing machine 1 from the active state to the inactive state by switching the second contact member 22A from a state in contact with the second cam 10 to a state out of contact with the second cam 10. In this case, the switch mechanism 3 readily switches the sewing machine 1 from the active state to the inactive state via the second cam 10 and the second contact member 22A.

Modifications

The disclosure may not be limited to the above-described illustrative embodiment, and various changes may be applied therein. The feed dog 2A may be vertically driven to move a workpiece by the vertical drive mechanism 2 which is driven by another motor different from the sewing machine motor rotationally driving the lower shaft 1A. The switch mechanism 3 may switch the sewing machine 1 between the active state and the inactive state by connecting and disconnecting a transmission path for transmitting a rotational force of another motor to the vertical drive mechanism 2. The cutting mechanism 5 may include only the cutter 5C with the blade 57 and lack the first thread catcher 54 and the second thread catcher 58. The relations between the drive conditions of the switch mechanism 3 and the cutting mechanism 5 and the states of the motor M (e.g., the initial state, first state, third state, and second state) may not be limited to those in the above-described embodiment. For example, the motor M may rotate only in the first direction and not rotate in the second direction. The motor M may rotate in the first direction to drive the switch mechanism 3 and the cutting mechanism 5 as in the above-described embodiment.

The switch mechanism 3 may be directly driven by the second gear 6C, not via the first cam 60 and the second contact member 22A. For example, the switch mechanism 3 may switch the transmission path for the rotational drive force of the lower shaft 1A from connected to disconnected by moving a rack gear in mesh with the second gear 6C in the left-right direction. The first cam 60 may be provided separately from the second gear 6C. For example, the first cam 60 may be directly connected to the rotation shaft Ma of the motor M so as to rotate as the motor M rotates. The radius of the arc 62 extending along the side surface 6S of the first cam 60 between the contact positions P1 and P3 may be L3 in the entire range between the contact positions P1 and P3. The sewing machine 1 may include an electromagnetic clutch disposed at the transmission path for the rotational drive force of the lower shaft 1A. The switch mechanism 3 may switch the transmission path for the rotational drive force of the lower shaft 1A from connected to disconnected by switching a state of the electromagnetic clutch from connected to disconnected. In this case, the sewing machine 1 may lack the second cam 10 of the lower shaft 1A and the second contact member 22A of the vertical drive mechanism 2.

Others

The first thread catcher 54 and the second thread catcher 58 are each an example of a thread catcher according to an aspect of the disclosure. The fourth urging member 36 is an example of an urging member according to an aspect of the disclosure. The contact position P1 corresponds to a first contact position according to an aspect of the disclosure. The contact position P2 corresponds to a second contact position according to an aspect of the disclosure. The contact position P3 corresponds to a third contact position according to an aspect of the disclosure. The arc 63 corresponds to a first arc according to an aspect of the disclosure. The arc 62 corresponds to a second arc according to an aspect of the disclosure.

What is claimed is:

1. A sewing machine comprising:

a needle plate;

a feed dog configured to move a workpiece;

a vertical drive mechanism configured to vertically drive the feed dog;

a switch mechanism configured to switch from an active state where the feed dog is driven, by the vertical drive mechanism, above and below an upper surface of the needle plate to an inactive state where an upper surface of the feed dog is maintained below the upper surface of the needle plate;

a cutting mechanism including a blade configured to cut a thread at a position below the needle plate;

a motor configured to commonly drive the switch mechanism and the cutting mechanism; and a lower shaft configured to be rotationally driven by a sewing machine motor to drive a shuttle mechanism located below the needle plate, wherein the feed dog is configured to be driven frontward and rearward by a rotational drive force of the lower shaft to move the workpiece, wherein the switch mechanism is configured to switch between:

the active state where a transmission path for transmitting the rotational drive force of the lower shaft to the vertical drive mechanism is connected, and the vertical drive mechanism drives, in response to the rotational drive force, the feed dog above and below the needle plate while the feed dog is driven frontward and rearward to move the workpiece; and the inactive state where the transmission path is disconnected, and the upper surface of the feed dog is maintained below the upper surface of the needle plate, wherein the cutting mechanism includes a thread catcher configured to catch and guide a thread at the position below the needle plate, and the blade is configured to cut the thread guided by the thread catcher, and wherein the motor is configured to rotate such that:

while the motor rotates from an initial state in a first direction by a first angle, the transmission path stays connected;

when the motor is brought into a first state after rotating from the initial state in the first direction by the first angle, the motor drives the switch mechanism to switch the transmission path from connected to disconnected;

while the motor rotates from the first state to a second state in the first direction by a second angle and then rotates from the second state to the initial state in a second direction opposite to the first direction, the transmission path is maintained disconnected; and at a point of time during rotation of the motor from the second state to the first state in the second direction by the second angle, the motor drives the cutting mechanism to cut the thread.

2. The sewing machine according to claim 1, further comprising:

a gear unit and a first cam which are rotatable in response to rotation of the motor; and a first contact member configured to contact the first cam and movable in response to rotation of the first cam, wherein the cutting mechanism is configured to be driven, in response to rotation of the gear unit, to cut the thread, and wherein the switch mechanism is configured to, upon movement of the first contact member, switch the transmission path from connected to disconnected.

3. The sewing machine according to claim 2, wherein the gear unit includes a first gear coupled to a rotation shaft of the motor, and a second gear rotatable in response to rotation of the first gear and including the first cam, wherein the cutting mechanism is driven, in response to rotation of the second gear, to cut the thread, and wherein the switch mechanism is configured to, upon movement of the first contact member by the first cam rotating in response to rotation of the second gear, switch the transmission path from connected to disconnected.

4. The sewing machine according to claim 2, further comprising an urging member configured to urge the motor in a direction in which the motor rotates in the second direction, wherein the first cam defines on a side surface thereof to be contacted by the first contact member in response to rotation of the motor:

a first contact position at which the first contact member contacts the side surface when the motor is in the first state;

a second contact position at which the first contact member contacts the side surface when the motor is in the second state;

a third contact position located between the first contact position and the second contact position and offset toward the first contact position from a midpoint between the first contact position and the second contact position;

a first arc extending, along the side surface, between the second contact position and the third contact position, as a part of a circle about a rotation axis of the first cam; and a second arc extending, along the side surface, between the third contact position and the first contact position and having a radius which decreases from the third contact position toward the first contact position.

5. The sewing machine according to claim 1, further comprising an urging member configured to urge the motor in a direction in which the motor rotates in the second direction.

6. The sewing machine according to claim 1, wherein the vertical drive mechanism includes a second contact member switchable between a state in contact with a second cam of the lower shaft for bringing the sewing machine in the active state, and a state out of contact with the second cam for bringing the sewing machine in the inactive state, and wherein the switch mechanism is configured to switch the second contact member from the state in contact with the second cam to the state out of contact with the second cam, thereby switching the sewing machine from the active state to the inactive state.

* * * * *